US005749105A

United States Patent [19]

Bruno et al.

[11] Patent Number: 5,749,105

[45] Date of Patent: May 12, 1998

[54] DRAIN ASSEMBLY

[75] Inventors: James F. Bruno, 650 Greentree, Ada, Mich. 49301; Albert L. Hass, Grand Rapids, Mich.

[73] Assignee: James F. Bruno, Ada, Mich.

[21] Appl. No.: 525,361

[22] Filed: Sep. 7, 1995

[51] Int. Cl.[6] ..... A47K 1/14

[52] U.S. Cl. ..... 4/295

[58] Field of Search ..... 4/286, 287, 295, 4/688, 689

[56] References Cited

U.S. PATENT DOCUMENTS 3,525,105 8/1970 Richards ..... 4/287
4,720,877 1/1988 Watts ..... 4/286
4,908,883 3/1990 Rivera ..... 4/295

*Primary Examiner*—Charles E. Phillips
*Attorney, Agent, or Firm*—Bullwinkel Partners,Ltd.

[57] ABSTRACT

A drain assembly which improves on the durability, economy and ease of manufacture and maintenance of previous drain assemblies. The drain assembly has a cartridge that threads onto a drain body. A spud or stopper slides up and down along the cartridge to open or close a drain. The improvement lies in a series of flexible structures extending outwardly from the cartridge to generate friction against the inner wall of the spud, holding the spud in the open of closed position. These structures may be finlike structures, bowlike structures, or both. The cartridge with the finlike structures and bowlike structures may be formed of a single piece of flexible plastic.

15 Claims, 2 Drawing Sheets

DRAIN ASSEMBLY

SPECIFICATION

James F. Bruno and Albert L. Hass, have invented certain new and useful improvements in a Drain Assembly, of which the following is a specification.

BACKGROUND OF THE INVENTION

This invention relates to drain assemblies for stopping sinks, tubs, or the like. These closures require a stopper by which the user can open or close the drain. A drain assembly must be economical to manufacture and maintain, easy for the user to operate, and durable.

There are at least three general types of drain assemblies. In one type, a strainer bowl rests on the bottom of the sink drain, above the drain hole. A stopper is suspended from the strainer bowl by a cartridge mounted on the strainer, and the drainer is opened and closed by raising or lowering the stopper into the drain hole. In a second type, a strainer screws into a threaded drain hole. A cartridge is threaded into the center of the strainer and a stopper rides along the cartridge above the strainer. The drain is opened by raising the stopper along the cartridge above the strainer and the drain is closed by lowering the stopper so that the stopper forms a seal against the strainer.

In a third type, a pop-up type stopper is connected to a trip lever by a linkage mechanism. The trip lever is usually mounted on the sink or tub. The stopper is raised or lowered by moving the trip lever up or down. The primary disadvantage of drain assemblies having a pop-up type stopper connected to a linkage-mechanism is that the linkage mechanism often gets out of alignment. When this happens, the stopper becomes difficult or impossible to raise and lower.

In drain assemblies incorporating a cartridge, some means is required to hold the stopper in the open or closed position along the cartridge. A wide variety of mechanisms have been utilized for this purpose. In more complicated mechanisms, the stopper is held in an up or down position by a spring loaded ball (Cendrowski U.S. Pat. No. 5,165,118), or some set of interlocking parts (Liou U.S. Pat. No. 4,359,788; Hamburg U.S. Pat. No. 3,813,708). The disadvantages of these types of mechanisms include the expense of manufacture, difficulty of installation and maintenance, and the ease with which a complicated mechanism can get clogged by debris or grime.

In simpler mechanisms, the stopper is held in the up or down position by the frictional force of an O-ring between the cartridge and stopper (Swanson U.S. Pat. No. 4,369,531), the frictional force of a metal ring between the cartridge and stopper (Watts U.S. Pat. No. 4,720,877), or a cartridge made of a soft nylon material such that the entire cartridge deforms to form a frictional fit with a guide hole in the strainer body (Smith U.S. Pat. No. 4,706,306). One disadvantage of these mechanisms is a lack of durability. Once the frictional members begin to wear, the mechanism stops working.

The present invention is an improvement over the friction type stoppers in that it provides a means to hold the stopper in the open or lower position utilizing a more sophisticated means of generating friction. The stopper slides along a cartridge whose surface contains a plurality of structures whose shapes generate friction against the stopper.

Without springs or interlocking parts, the present invention avoids the drawbacks of more complex mechanisms. The present invention contains a series of structures on the outside circumferential surface of the cartridge which generate significantly more friction between the cartridge and the stopper than is generated by a simple O-ring or metal ring.

In the preferred embodiment, the surface structures of the present invention include flexible finlike structures and flexible bowlike structures which extend outward beyond the circumferential surface of the cartridge and contact the inside wall of the spud. The cartridge may comprise two halves connected by the bowlike structures and a connecting member, with the finlike structures extending radially outward from both halves. The combination of the bowlike structures and the connecting member allows the bowlike structures to resist force applied from the spud wall, to flex inward if sufficient force is applied, and to return to their original configuration once the force is removed.

By utilizing these structures the present invention will operate more consistently and for a longer duration than mechanisms utilizing friction between more basic shapes.

SUMMARY OF THE INVENTION

Accordingly, an object of the present invention is to provide a novel drain assembly for holding a stopper in an open or closed position that lasts longer than conventional drain assemblies.

Another object is to provide a drain assembly that is relatively inexpensive to manufacture.

A further object is to provide a drain assembly that is easy to install and maintain.

Further and additional objects will appear from the description, accompanying drawings, and appended claims.

THE DRAWINGS

DETAILED DESCRIPTION OF THE INVENTION

Figure 1:
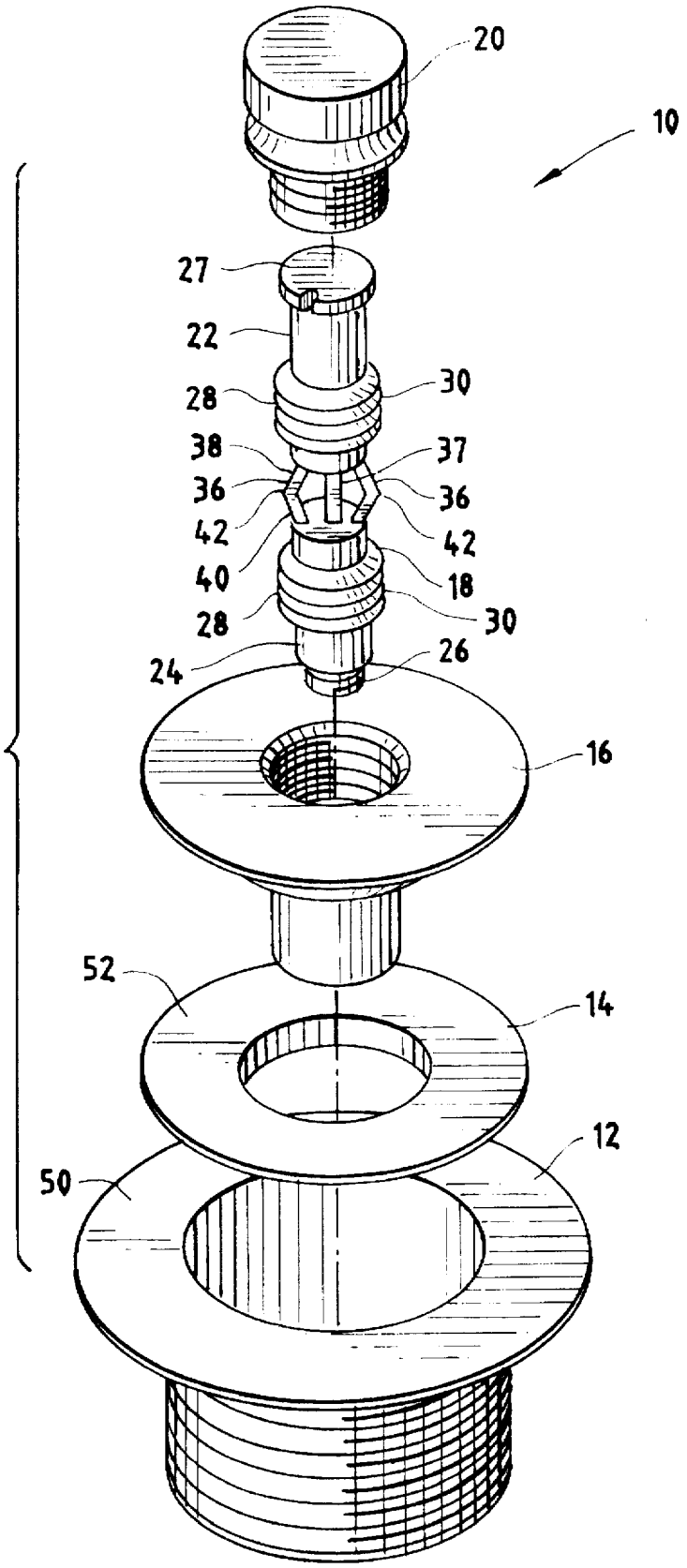
FIG. 1 is an exploded view of a drain assembly according to the present invention.

Turning to the drawings, FIG. 1 shows an exploded perspective view of the drain assembly 10 as it would be installed. The drain assembly 10 comprises a strainer body 12, a gasket 14, a spud or stopper 16, a cartridge 18, and a knob 20. The strainer body 12 threads into the drain of the sink or bathtub (not shown).

In the preferred embodiment, the cartridge 18 comprises an upstream portion 22 and a downstream portion 24, both of which are substantially cylindrical and have substantially the same diameter. The downstream portion 24 may comprise a threaded section 26 for making a threaded connection with the strainer body 12. The upstream portion 22 may have a head portion 27 at the end opposite the downstream portion 24.

Figure 2:
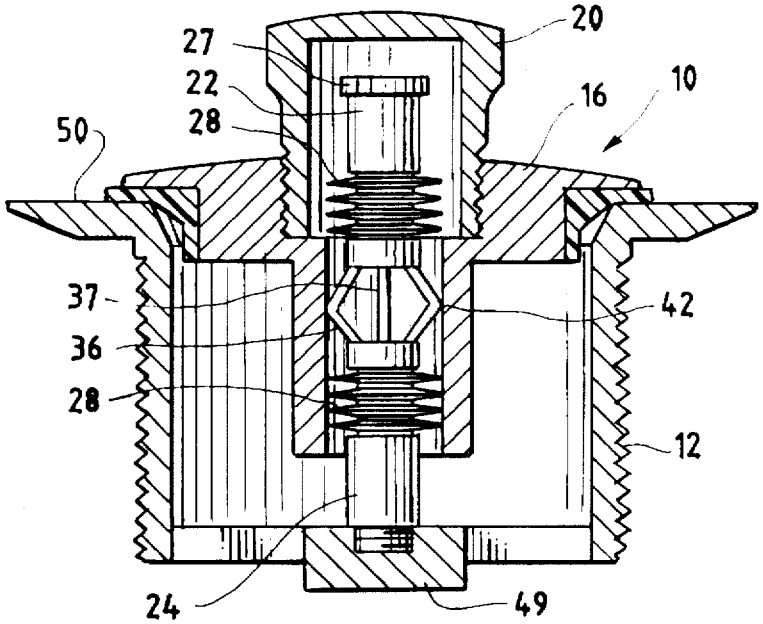
FIG. 2 is a cross sectional view of the drain assembly in the closed position.
Figure 4:
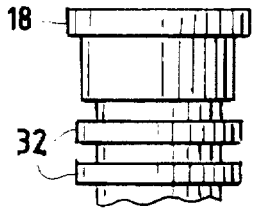
FIG. 4 is an enlarged view of an alternative embodiment of the finlike structures of the present invention.
Figure 5:
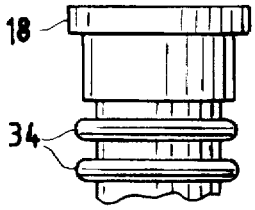
FIG. 5 is an enlarged view of a second alternative embodiment of the finlike structures of the present invention.
Figure 3:
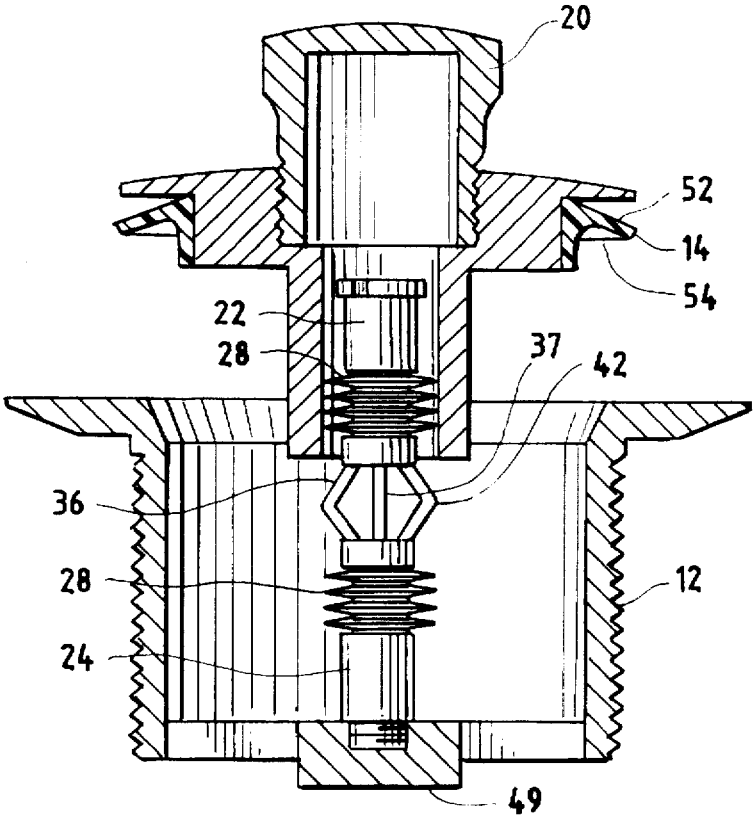
FIG. 3 is a cross sectional view of the drain assembly in the open position.

Preferably, a plurality of finlike structures 28 project radially from the cartridge upstream portion 22 and downstream portion 24. In the preferred embodiment, each finlike structure 28 extends radially to a thin outward edge 30, as shown in FIGS. 1–3. However, other finlike configurations are foreseen that would fall within the scope if the invention, including finlike structures having a flat outward edge 33, as shown in FIG. 4, or a rounded edge 34 as shown in FIG. 5. The number of finlike structures may also vary from that shown in the figures.

The numerous finlike structures 28 create a large area of contact between the cartridge 18 and the inner wall of the spud 16. This increased contact area serves to increase the amount of friction between the cartridge 18 and the spud 16. It also provides for increased durability because if one finlike structure 28 begins to wear out, the other finlike structures 28 will continue to hold contact. Also, the thin structure of the individual finlike structures 28, as compared to a metal ring or rubber O-ring, provides flexibility which allows the finlike structures 28 to be subjected to a force from the spud wall or some intervening obstruction without permanently deforming.

In the preferred embodiment, bowlike structures 36 extend between the cartridge upstream and downstream portions 22, 24, as does a connecting member 37. Preferably, the connecting member 37 is centrally disposed along the central vertical axis of the cartridge 18.

Figure 6:
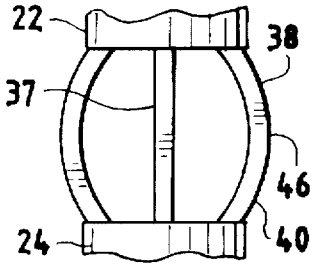
FIG. 6 is an enlarged view of an alternative embodiment of the bowlike structures of the present invention.
Figure 7:
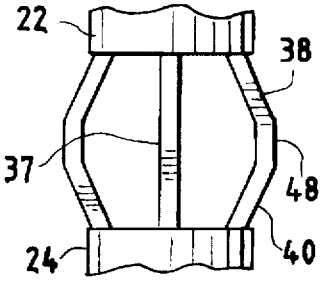
FIG. 7 is an enlarged view of a second alternative embodiment of the bowlike structures of the present invention.

The bowlike structures 36 are bowed outward and have an upper leg 38, a lower leg 40, and an outermost portion 42 therebetween that contacts the inner wall of the spud 16. Preferably, the bowlike structures 36 are configured such that the outermost portion 42 is a substantially flat edge. (As viewed from the front in FIGS. 1–3, the outermost portions 42 appear to be points.) However, other configurations for the outermost portions are anticipated that fall within the scope of the invention, such as a rounded surface 46 as shown in FIG. 6, or even a flat surface 48, as shown in FIG. 7.

While it is preferred that the finlike structures 28 and bowlike structures 36 would be used in tandem, it is contemplated that the cartridge 18 may have either only finlike structures 28 or bowlike structures 36.

The bowlike structures 36 generate consistent and durable friction between the cartridge 18 and the spud 16. The bowlike structures 36 are configured such that they extend outward away from the circumferential surface of the cartridge 18. As the inner wall of the spud 16 pushes against the cartridge 18, the outermost portion 42 of each bowlike structure 36 is pushed slightly inward, which causes the upper leg 38 to push upwards on the upstream portion 22 of the cartridge 18 and the lower leg 40 to push downward on the downstream portion 24 of the cartridge 18. However, because the upstream and downstream portions 22, 24 are held together by a connecting member 37, the bowlike structures 36 will resist more than a slight deformation. A strong force applied to the outermost portions 42 of the bowlike structures 36 will cause the bowlike structures 36 to flex slightly inward by slightly stretching the connecting member 37. Once the force on the outermost portions 42 of the bowlike structures 36 is reduced, the structure of the bowlike structure—connecting member combination helps return the cartridge 18 to its original shape. In this manner the structure of the bowlike structures 36 maintains a relatively consistent and durable force on the inner wall of the spud 16.

Preferably the cartridge is formed of a flexible material such as plastic, nylon, or rubber. However, other suitable materials may be used and are contemplated as being within the scope of the invention.

While the preferred embodiment of the cartridge 10 comprises an upstream portion 22 and a downstream portion 24 connected by bowlike structures 36 and a connecting member 37, it is contemplated that the cartridge may comprise a single substantially cylindrical body with bowlike structures and/or finlike structures extending radially therefrom. In this alternative embodiment, there would be no connecting member.

The gasket 14, spud 16, cartridge 18, and knob 20 are assembled together. The cartridge head portion 27 fits within the knob 20, which then threads into the top of the spud 16. The rubber gasket 14 slides over the bottom of the spud 16.

The assembled gasket 14, spud 16, cartridge 18, and knob 20 are then mated to the strainer body 12 by threading the cartridge threaded section 26 into the strainer body threaded portion 49 (FIG. 2). In this way the cartridge 18 is secured to the strainer body 12.

The drain assembly 10 works in the following manner. The gasket 14, spud 16, and knob 20 ("stopper assembly") have a certain range of motion along the cartridge 18. To open the drain, the stopper assembly is lifted upwards along the cartridge 18, which remains secured to the strainer body 12. As the stopper assembly slides along the cartridge 18, the finlike structures 28 and the bowlike structures 36 rub against the inside surface of the cylindrical portion of the spud 16. The friction generated holds the stopper assembly in the open position, as shown in FIG. 3.

To close the drain, the stopper assembly is pushed down along the cartridge 18 until the gasket 14 is seated firmly against the upper surface 50 of the strainer body 12. The drain is sealed by the pressure between the spud 16 and the top surface 52 of the gasket 14, and between the bottom surface 54 of the gasket 14 and the top surface 50 of the strainer body 12, as shown in FIG. 2.

Of course, many other modifications and other embodiments of our invention will be recognized by one skilled in the art in view of the foregoing teachings. Therefore, the invention is not to be considered limited to the exact construction described, and any suitable modifications are to be included within the scope of the claims allowed herein.

We claim as our invention:

1. A cartridge for a drain assembly comprising:

a substantially cylindrical body having a circumference and substantially cylindrical upstream and downstream portions connected by a plurality of outwardly extending bowlike structures having an outermost surface extending beyond the circumference of the body; and a plurality of finlike structures extending radially from the body and having edges that extend beyond the circumference of the body.

2. The cartridge of claim 1 further comprising a connecting member interposed between the upstream and downstream cartridge body portions.

3. A cartridge for a drain assembly comprising:

a substantially cylindrical body having a circumference and substantially cylindrical upstream and downstream portions connected by a plurality of outwardly extending bowlike structures extending radially from the body and having an outermost surface extending beyond the circumference of the body for providing contact with a spud to hold the cartridge in position relative to the spud.

4. The cartridge of claim 3 further comprising a connecting member interposed between the upstream and downstream cartridge body portions.

5. The cartridge of claim 3 further comprising means for maintaining a constant outward tension on the bowlike structures.

6. A cartridge for a drain assembly comprising:

a body having an upstream portion and a downstream portion of substantially the same circumference;

a first set of finlike structures extending radially from the upstream portion of the cartridge body having a circumference slightly greater than the circumference of the upstream body portion;

a second set of finlike structures extending radially from the downstream portion of the cartridge body and having a circumference slightly greater than the circumference of the upstream body portion;

a plurality of bowlike structures interposed between the cartridge body upstream and downstream portions, each bowlike structure having an upper leg, a lower leg, and an outermost portion therebetween, such that the outermost portion extends slightly beyond the circumference of the cartridge body; and means for maintaining a constant outward tension on the bowlike structures.

7. The cartridge of claim 6 wherein each finlike structure extends radially to a thin outward edge.

8. The cartridge of claim 6 wherein each finlike structure have extends radially to a flat outward edge.

9. The cartridge of claim 6 wherein each finlike structure extends radially to a rounded outward edge.

10. The cartridge of claim 6 wherein the outermost portion of each bowlike structure is a thin edge.

11. The cartridge of claim 6 wherein the outermost portion of each bowlike structure is a rounded surface.

12. The cartridge of claim 6 wherein the outermost portion of each bowlike structure is a flat surface.

13. The cartridge of claim 6 wherein the means for maintaining a constant outward tension on the bowlike structures is a connecting member interposed between the upstream and downstream body portions.

14. The cartridge of claim 6 wherein the cartridge is formed of a flexible material, wherein the flexible material is selected from the group consisting of plastic, nylon, and rubber.

15. A drain assembly for controlling the flow of water through a drain, said drain assembly comprising:

a strainer body;

a cartridge adapted to be mounted to the strainer body and having a circumference, upstream and downstream portions, a plurality of radially extending finlike structures having edges that extend beyond the circumference, a plurality of outwardly extending bowlike structures having an outermost surface extending beyond the circumference, said upstream and downstream portions connected by the bowlike structures, a connecting member interposed between the upstream and downstream portions, and a head portion opposite the downstream body portion;

a knob adapted to fit securely over the head portion;

a spud mounted on the cartridge in a sliding fashion such that the spud may be raised or lowered with respect to the cartridge; and a gasket affixed to the spud for providing a watertight fit between the spud and the strainer body when the spud is in the lowered position.

* * * * *